US005304848A

United States Patent [19]

Schwendt

[11] Patent Number: 5,304,848

[45] Date of Patent: Apr. 19, 1994

[54] DRIVE UNIT FOR VEHICLES DRIVEN ON RAILS

[75] Inventor: Lutz Schwendt, Vellmar, Fed. Rep. of Germany

[73] Assignee: ABB Patent GmbH, Mannheim, Fed. Rep. of Germany

[21] Appl. No.: 975,661

[22] Filed: Nov. 13, 1992

[30] Foreign Application Priority Data

Nov. 13, 1991 [DE] Fed. Rep. of Germany ..... 4137263

[51] Int. Cl.[5] ..... B61C 9/38; B61C 9/00

[52] U.S. Cl. ..... 290/45; 105/131; 105/136; 290/8

[58] Field of Search ..... 290/8, 45; 105/131, 105/136

[56] References Cited

U.S. PATENT DOCUMENTS 3,792,666 2/1974 Coho et al. ..... 105/136
3,841,228 10/1974 Hall ..... 105/131

FOREIGN PATENT DOCUMENTS 846107 8/1952 Fed. Rep. of Germany .
2239866 2/1974 Fed. Rep. of Germany .
2843830 4/1980 Fed. Rep. of Germany .
3605703 8/1987 Fed. Rep. of Germany .

*Primary Examiner*—A. D. Pellinen
*Assistant Examiner*—Robert Lloyd Hoover
*Attorney, Agent, or Firm*—Herbert L. Lerner; Laurence A. Greenberg

[57] ABSTRACT

A drive unit for vehicles driven on rails includes an electric drive motor having a rotor shaft with first and second ends. A rotor is disposed on the rotor shaft. A pinion is secured to the rotor shaft toward the first end. A transmission is connected to and acted upon by the drive motor for driving a wheel set. A common housing is provided for the drive motor and the transmission. First and second step bearings support the rotor shaft. The first step bearing is disposed in the housing at the first end of the rotor shaft, for supporting the rotor shaft toward the pinion with the pinion being secured on the rotor shaft between the rotor and the first step bearing.

3 Claims, 1 Drawing Sheet

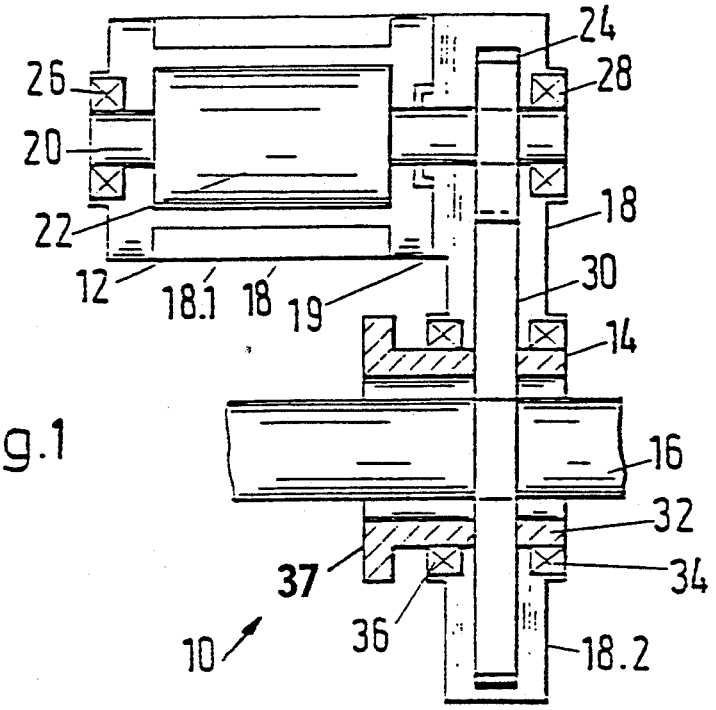
Fig.1
Fig.2
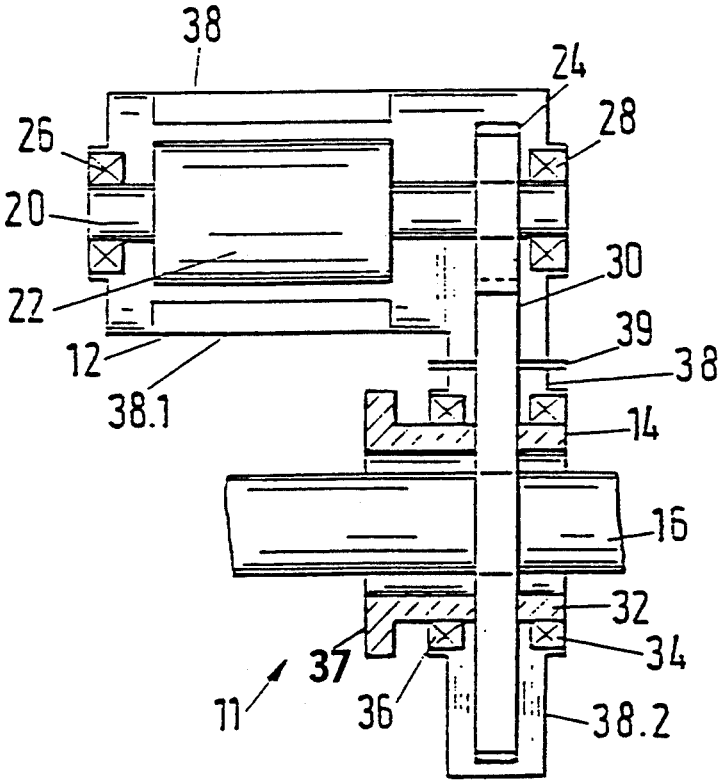

DRIVE UNIT FOR VEHICLES DRIVEN ON RAILS

The invention relates to a drive unit for vehicles driven on rails, having an electric drive motor with a rotor shaft supported in step bearings, the shaft carrying a rotor or armature and a pinion, and a transmission being acted upon by the drive motor and joined to it for driving a wheel set.

Drives for vehicles driven on rails are known, in which an electric drive motor, typically with the interposition of a transmission, acts upon an associated wheel set with a drive torque. The connection between the drive unit, formed of the drive motor and the transmission, and the wheel set, is made by means of a cardanically movable, connected hollow shaft which is disposed concentrically with the axle of the wheel set.

A disadvantageous feature of the known drives is the disposition of the step bearings for the rotor shaft. The step bearings receive the rotor between them, and the pinion is floatingly supported on a shaft journal protruding toward the transmission, so that the step bearing of the rotor shaft on the power takeoff side must absorb not only the drive torque but also a bending moment of the rotor shaft. That presents problems in terms of constructing the bearing, because on one hand the bearing must not become too large in view of the desired high engine speed, but on the other hand the desired high torque requires a large bearing diameter.

The aforementioned high radial bearing load resulting from the tooth forces between the pinion and the transmission gear wheel as a result of a floating pinion bearing, is superimposed on the divergent performance characteristics for constructing the step bearings. Arbitrarily enlarging the step bearing of the rotor shaft toward the pinion is possible only to a limited extent. Due to the space available, the drive motors being used cannot be allowed to exceed a certain size and therefore must be operated at relatively high rpm, which places an upward limit on the bearing size.

A further problem in conventional drives results from the fact that the drive motor on one hand and the transmission on the other hand are assembled in the form of individual components, and manipulating them entails some effort and expense.

It is accordingly a object of the invention to provide a drive unit for vehicles driven on rails, which overcomes the hereinafore-mentioned disadvantages of the heretofore-known devices of this general type, which is simple to manipulate, and in which the bearing load o the step bearing of the rotor shaft toward the pinion is lessened, while the performance characteristics are otherwise the same.

With the foregoing and other objects in view there is provided, in accordance with the invention, a drive unit for vehicles driven on rails, comprising an electric drive motor having a rotor shaft with first and second ends; a rotor disposed on the rotor shaft; a pinion secured to the rotor shaft toward the first end; a transmission connected to and acted upon by the drive motor for driving a wheel set; a common housing for the drive motor and the transmission; and first and second step bearings supporting the rotor shaft, the first step bearing being disposed in the housing at the first end of the rotor shaft, for supporting the rotor shaft toward the pinion with the pinion being secured on the rotor shaft between the rotor and the first step bearing.

The advantage of the structure according to the invention is based on the fact that the individual components of the drive unit, namely the drive motor and the transmission, are preassembled for installation in the vehicle driven on rails and can then be manipulated in one piece. According to the invention, the drive motor has no end shield on the power takeoff side at which the pinion is disposed on the rotor shaft, but instead the step bearing on that side is an integral component of the common housing.

According to a suitable feature of the invention, a joint of the common housing may be located in the plane in which the end shield on the power takeoff side was originally located, so that the connection between the two housing parts can be made in the conventional manner by means of tie rods. This kind of structure is advantageous from the standpoint that the previously typical components of the drive motor, with the exception of the end shield on the power takeoff side, can be retained.

However, in accordance with a concomitant feature of the invention, there is provided a joint, which is necessary for reasons of individual assembly of the various components, being disposed parallel or perpendicular to the rotor axis.

Other features which are considered as characteristic for the invention are set forth in the appended claims.

Although the invention is illustrated and described herein as embodied in a drive unit for vehicles driven on rails, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a fragmentary, diagrammatic, elevational view of a drive unit in accordance with a first embodiment of the invention; and FIG. 2 is a view similar to FIG. 1 of a drive unit in accordance with a second embodiment.

Referring now to the figures of the drawing in detail and first, particularly, to FIG. 1 thereof, there is seen a drive unit 10 which includes a drive motor 12 and a transmission 14, through which a wheel axle 16 passes without contact, in a common housing 18. The common housing 18 is divided along a joint 19 into two parts 18.1, 18.2, one of which receives the drive motor 12 and the other of which receives the transmission 14.

The drive motor 12 has a housing with an interior containing a rotor shaft 20 with a first end toward the right and a second end toward the left, in FIG. 1. The rotor shaft 20 has a rotor or armature 22 disposed thereon and a pinion 24 secured thereto toward the first end of the rotor shaft 20.

The rotor shaft 20 is supported in first and second step bearings 28, 26, each being located at a respective one of the first and second ends of the rotor shaft 20. While the second step bearing 26 is placed in the housing part 18.1 that encompasses the rotor 22, the first step bearing 28 that is disposed toward the pinion is placed in the housing part 18.2 receiving the transmission 14.

Fastening elements for connecting the two housing parts 18.1 and 18.2, which are preferably of the type provided with conventional tie rods, are not shown in the drawing.

The transmission 14, which is highly diagrammatically illustrated, has a main transmission wheel 30 that is disposed on a hollow shaft 32 which is supported in step bearings 34, 36. One end of the hollow shaft 32 has a flange 37 for fastening a coupling by means of which a connection is made with a non-illustrated wheel set having the axle 16. A further gear wheel, in the form of an intermediate wheel or a pair of gear wheels, may selectively be additionally disposed in the transmission housing as a step-down stage.

The drawing also does not show conventional fastening devices provided on the housing parts, by means of which the drive unit 10 is fastened to a vehicle driven on rails. Individual provisions made in the interior of the housing 18 for sealing off the housing part 18.2 that is filled with oil and receives the transmission 14, and for sealing off the housing part 18.2 from the housing part 18.1 receiving the motor 12, are known and are therefore not described in detail herein.

FIG. 2 shows a corresponding drive unit 11 which is virtually identical to the configuration of FIG. 1 and which is assembled from a drive motor 12 and a transmission 14 that includes an axle 16 of a non-illustrated wheel set passing through without contact, which are disposed in a common housing 38. Accordingly, the same description that was already given for FIG. 1 applies for the reference numerals that are also indicated in FIG. 2.

The essential difference between the embodiment of FIG. 1 and the configuration shown in FIG. 2 is that unlike FIG. 1, the configuration of FIG. 2 has a housing with a joint 39 extending parallel to the axle 16 or to the rotor shaft 20 of the drive motor 12 or to the hollow shaft 32 of the transmission 14. This joint divides the common housing 38 into a housing part 38.1 toward the drive motor and a housing part 38.2 toward the transmission.

An essential feature of both of the configurations shown in FIGS. 1 and 2 is the disposition of the step bearing 28 disposed toward the pinion, which is located in such a position that the pinion 24 is disposed between the step bearing 28 and the rotor 22, on the end of the rotor shaft 20 in the housing 38.

The two configurations, that is the drive unit 10 of FIG. 1 and the drive unit 11 of FIG. 2, differ from conventional constructions due to the fact that, among other factors, a conventional end shield for receiving the step bearing 26 is provided only on the side opposite the pinion, or in other words on the left side as seen in the drawings. On the opposite side a housing segment is provided instead of the otherwise typical end shield. In FIG. 1 the housing segment is a component of the housing part 18.2 disposed toward the transmission and in FIG. 2 the housing segment is a component of the housing part 38.1 disposed toward the drive motor.

I claim:

1. A drive unit for vehicles driven on rails, comprising:

an electric drive motor having a rotor shaft with first and second ends;

a rotor disposed on said rotor shaft between said first and second ends;

a pinion selected to said rotor shaft toward said first end;

a transmission connected to and acted upon by said drive motor for driving a wheel set;

a common housing for said drive motor and said transmission; and first and second step bearings supporting said rotor shaft in said housing, said first step bearing being disposed in said housing at said first end of said rotor shaft, for supporting said rotor shaft toward said pinion with said pinion being secured on said rotor shaft between said rotor and said first step bearing, and said second step bearing being disposed in said housing at said second end of said rotor shaft.

2. The drive unit according to claim 1, including a joint substantially perpendicular to said rotor shaft for dividing said common housing into two mutually separate housing parts.

3. The drive unit according to claim 1, including a joint substantially parallel to said rotor shaft for dividing said common housing into two mutually separate housing parts.

* * * * *